US006447593B1

(12) United States Patent
Sargent et al.

(10) Patent No.: US 6,447,593 B1
(45) Date of Patent: Sep. 10, 2002

(54) FOUNDRY SAND WITH OXIDATION PROMOTER

(75) Inventors: Nicholas Edward Sargent, Canton; June-Sang Siak, Troy; Mei Cai, Bloomfield Hills, all of MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/832,469

(22) Filed: Apr. 12, 2001

(51) Int. Cl.[7] ..... B22C 9/02; B22C 1/02; B22C 1/20; B28B 7/28

(52) U.S. Cl. ..... 106/38.4; 106/157.7; 106/157.8; 106/160.1; 106/157.2; 164/5; 164/525; 164/520; 164/528; 164/529

(58) Field of Search ..... 106/38.25, 38.4, 106/157.7, 157.8, 160.1, 157.2; 164/525, 520, 349, 14, 369, 528, 529, 5

(56) References Cited

U.S. PATENT DOCUMENTS

| | | | | |
|---|---|---|---|---|
| 5,320,157 | A | 6/1994 | Siak et al. | 162/12 |
| 5,582,231 | A | 12/1996 | Siak et al. | 164/525 |

*Primary Examiner*—Michael Marcheschi
(74) *Attorney, Agent, or Firm*—Kathryn A. Marra

(57) ABSTRACT

Coating foundry sand with a thin layer of an oxidation-promoting catalyst. Preferred catalysts comprise ferric and cupric oxides. The catalysts promote the oxidation of any polymeric binder or residues admixed with the sand. The sand is coated by wetting the grains with a solution of a catalyst precursor, drying the sand and baking the sand in air to convert the precursor to the catalyst.

6 Claims, 1 Drawing Sheet

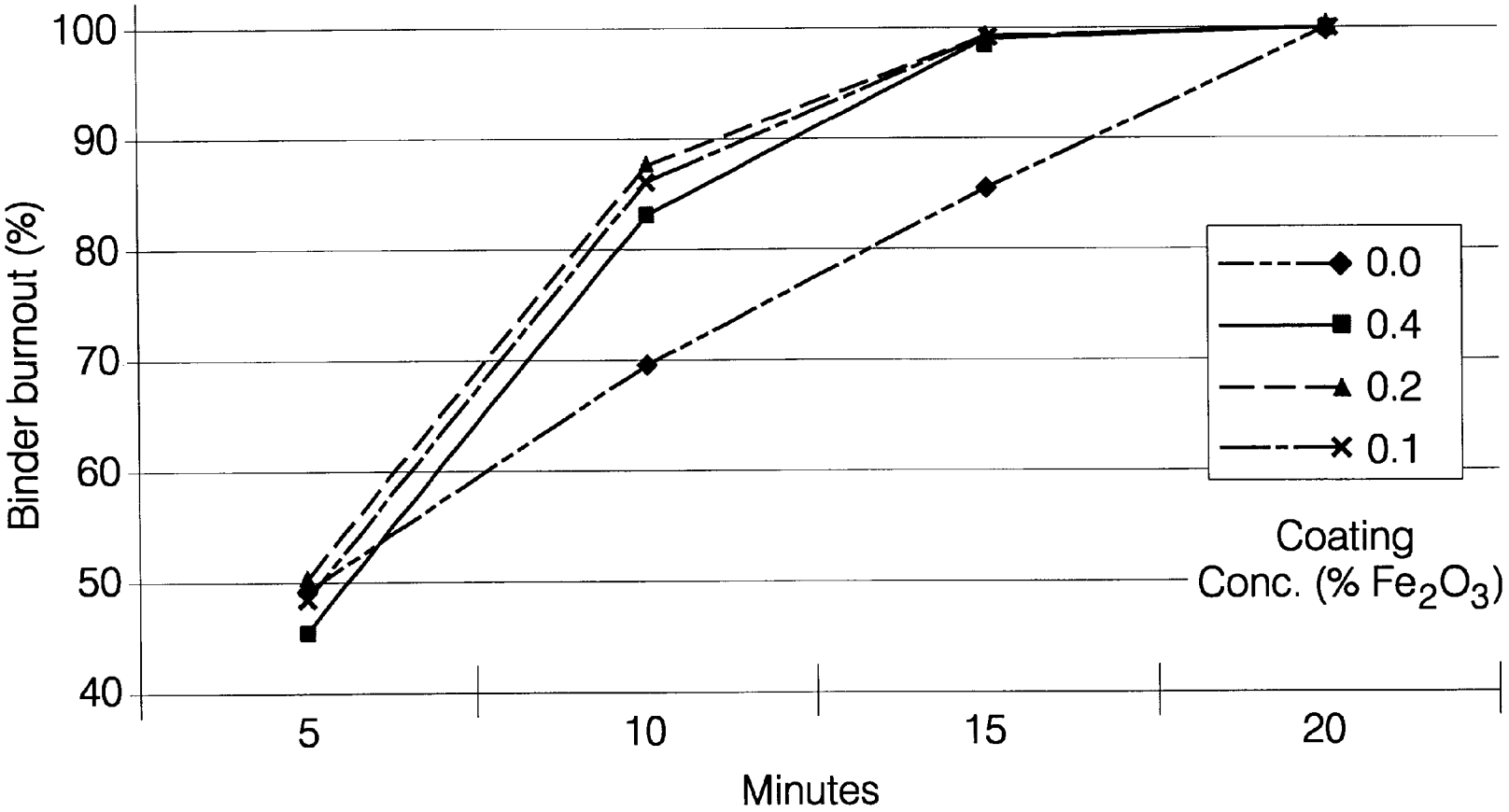
Binder burnout (%)
100
90
80
70
60
50
40
5
10
15
20
Minutes
Coating
Conc. (% $Fe_2O_3$)
0.0
0.4
0.2
0.1

FOUNDRY SAND WITH OXIDATION PROMOTER

TECHNICAL FIELD

This invention relates to catalyst-coated foundry sand, and processes for making and using same.

BACKGROUND OF THE INVENTION

Molds for casting molten metals comprise several mold members working together to define the internal and external shape of the casting. Such members include core members for forming and shaping interior cavities in the casting, as well as cope/drag/shell members for forming and shaping the exterior of the casting. Such mold members are made by (1) mixing sand with a binder, (2) introducing (e.g., blowing) the binder-sand mix into a mold containing a pattern for shaping the sand-binder mix to the desired shape, and (3) curing/hardening the binder in the pattern mold to fix the shape of the mold member. During casting, molten metal is poured into or around the mold member(s), and allowed to solidify. The internal cores are removed from the casting by (1) hammering, (2) shaking, (3) heating to oxidize and crumble the binder, or (4) combinations thereof.

A variety of polymers are commonly used as binders in the so-called "hot-box", "warm-box", "cold-box" and "no-bake" techniques for making such mold members, as is well known to those skilled in the foundry art. Gelatin (a biopolymer) is also used as a binder as taught by Siak et al U.S. Pat. No. 5,320,157 and Siak et al U.S. Pat. No. 5,582,231, which are herein incorporated by reference. Gelatin is desirable because it is water soluble, environmentally benign, and low cost. Moreover, less heat is required to break the bonds of the gelatin's protein structure and oxidize the binder than is required for the other polymer binders. As a result, cores made with gelatin break-down readily from the heat of the molten metal alone, and thereby permit ready removal of the core sand (e.g., by shaking) from the casting with a minimum of additional processing. Powdered oxidation-promoting catalysts (i.e. ferric oxide, ferric phosphate and/or ferric pyrophosphate) have been added to the gelatin-sand mix to promote breakdown of the gelatin binder at aluminum casting temperatures. Following casting, the core sand is baked to remove charred and uncharred gelatin and reconstituted by adding fresh gelatin, as well as additional powdered catalyst to make up for catalyst "fines" (small particles) lost in handling and processing the mix. This process requires monitoring of the $Fe_2O_2$ content of the sand to determine how much make-up $Fe_2O_2$ is required as well as measuring the needed amount and mixing with the sand. It would be desirable to simplify the reconstitution process by eliminating the need to have to determine how much catalyst is needed as well as have to handle and mix the catalyst powders with the binder-sand every time a new batch of sand is prepared.

Moreover, in the so-called "Lost Foam" process, a fugitive foam pattern (e.g. polystyrene) is submerged in a bed of loose sand. Molten metal (e.g. Al) is poured onto the foam, which causes the foam to liquefy/vaporize and escape into the bed of sand where some of it remains as a residue. The metal fills the cavity left by the vaporized foam. The sand is reclaimed by heating in air to a temperature of about 760° C. for about one hour to oxidize and remove the residue from the sand. It would be desirable if this reclamation process could be accomplished quicker and at a lower temperature.

The present invention contemplates foundry sand modified to (1) accelerate the thermal oxidation of polymer binders or residues in foundry sand for more effective break-down thereof, and/or (2) eliminate the need to have to add fresh catalyst powders to each batch of sand-binder mix. With the modified sand, cores can be readily removed from castings, and polymer residues readily removed from sand during reclamation thereof.

SUMMARY OF THE INVENTION

According to one aspect of the invention there is provided a reusable foundry sand whose individual grains are coated with an adherent layer of an oxidation catalyst that promotes the thermal oxidation of polymers mixed with the sand. The catalyst preferably comprises ferric oxide (most preferred) and/or cupric oxide. Catalyst loadings of less than about 0.1% by weight of the sand is all that is needed to obtain the benefits of the invention though higher amounts may be used.

According to another aspect of the invention, there is provided a method of preparing foundry sand to promote the thermal oxidation of polymers mixed therewith wherein the sand grains are (a) coated with a solution of a precursor of an oxidation-promoting catalyst selected from the group consisting of ferric oxide and cupric oxide, (b) dried to deposit the precursor on the grains, and (c) heated sufficiently to convert the precursor to the catalyst. The precursor is preferably selected from the group consisting of ferric and cupric salts, such as ferric chloride (most preferable), ferric phosphate, ferric pyrophosphate, ferric oxalate, cupric oxalate and cupric chloride, and will have, a loading, after drying, of less than about 0.3% by weight of the sand.

According to another aspect of the invention, there is provided a method of making an aluminum casting comprising the steps of forming a mold part from reusable polymer-bonded foundry sand whose grains are precoated with an adherent layer of an oxidation-promoting catalyst, and casting the aluminum against said mold part so as to shape the aluminum and heat the mold part sufficiently that the catalyst promotes the oxidation of the binder and crumbling of the mold part. Preferably, the binder comprises gelatin, and the catalyst comprises ferric oxide (most preferable) and/or cupric oxide.

According to another embodiment of the invention, there is provided a method of making a casting comprising (a) embedding a fugitive polymeric pattern (e.g. polystyrene) in a bed of foundry sand whose grains are coated with a layer of an oxidation-promoting catalyst, (b) pouring molten metal onto the pattern in the sand bed to vaporize the pattern and cause it to migrate into and contaminate the sand with residue from the pattern, (c) removing the casting from the bed, and (d) reclaiming the sand for reuse by heating the sand sufficiently for the catalyst to promote the oxidation and removal of the residue from the sand quicker and at a lower temperature than would be possible without the catalyst layer.

According to still another aspect of the invention, there is provided a method of making a casting comprising the steps of (a) forming a core from polymer-bonded foundry sand whose grains are precoated with a reusable adherent layer of an oxidation-promoting catalyst, (b) casting molten metal about the core so as to shape the inside of the casting, (c) allowing the casting to solidify, and then (d) heating the casting sufficiently for the catalyst to promote the oxidation of the polymer for easy shakeout of the core from the casting.

A particular advantage of the present invention is that the catalyst-coated sand can be used repeatedly without substantial loss of catalyst and without having to add fresh catalyst powder to the mix.

BRIEF DESCRIPTION OF THE DRAWINGS

FIG. 1 is a plot of the results of one test of the present invention.

DESCRIPTION OF THE PREFERRED EMBODIMENT

The invention will be better understood when considered in the light of the following detailed description thereof.

In accordance with the present invention, foundry sand is coated with an oxidation-promoting catalyst such as ferric oxide or cupric oxide in order to facilitate the burnout of polymers intermixed with the sand. The catalyst-coated sand can be used repeatedly without having to add makeup catalyst to the sand. The catalyst-coated sand is particularly useful in connection with (1) burning-out organic polymer binders from mold members such as cores, and (2) removing lost foam pattern residue resulting from the destruction of polystyrene lost foam patterns. The foundry sand may comprise any known foundry sand such as lake sand, zircon sand, silica sand, etc. and is coated by (1) mixing it with a solution of a precursor of the catalyst to form a slurry, (2) drying the slurry to deposit the precursor on the surface of the sand grains, and (3) baking the precursor-coated sand to convert the precursor to the catalyst. Suitable precursors comprise ferric chloride (most preferred), ferric phosphate, ferric pyrophosphate, ferric oxalate, cupric chloride and cupric oxalate, inter alia.

In the case of a mold member (e.g. a core), the sand is mixed with a suitable organic polymer binder, such as gelatin or any of the known "hot-box", "cold-box", "warm-box" or "no-bake" binders, and shaped in an appropriate mold. After the binder has cured and the core hardened, it is ready for the casting operation where molten metal is cast thereinto or thereabout. In some cases, heat from the molten metal alone is sufficient for the catalyst to promote the oxidation of the binder, and cause the mold member to crumble. In other cases, the casting may have to be subjected to additional heating to oxidize the binder. When the foundry sand has been used in the "lost foam" process and contaminated with pattern residue, the sand is reclaimed by heating it in air such that the catalyst causes burn-off of the residue in a shorter time, and at a lower temperature, than is possible without the catalyst coating. Catalyst-coated sand can be used over and over again without losing its catalytic properties and without the need to add catalyst powder to the sand.

EXAMPLE

Foundry lake sand was added to a 1.5%, by weight, solution of an oxidation-promoting-catalyst precursor comprising ferric chloride, and mixed until all of the sand grains were wetted by the solution. The resulting slurry was heated to a temperature between 80° C. and 120° C. until dry. The dried sand was next baked in air at a temperature of about 500° C. to convert the ferric chloride to ferric oxide which adhered to the surfaces of the sand grains. The catalyst-coated sand was then mixed with a gelatin binder such as disclosed in the aforesaid Siak et al. patents to yield a sand-binder mix having a gelatin content of 0.75%, by weight. The sand-binder mix was then formed into a core, ala the process described in Siak et al. U.S. Pat. No. 5,582,231, and molten aluminum poured thereabout at a temperature of about 650° C. The heat of the molten Al was sufficient to cause the gelatin to oxidize and the core to crumble. The core sand was removed from the Al casting, baked at 500° C. to remove any char therefrom and fresh gelatin added thereto. The new mix was used to form a second casting without the addition of any more catalyst. Similarly, the sand removed from the second casting was used to form a third casting without the addition of more catalyst. Finally, the sand removed from the third casting was used to make a fourth casting without the addition of more catalyst. As shown in the following table, the catalyst coating remained essentially with the sand grains throughout the four casting cycles. For this table, the amount of iron (in $\mu$g Fe/g sand) was determined at the beginning (i.e. before any casting), and between each cycle, by Inductively Coupled Plasma analysis using an iron standard.

| | Cycle 0 | Cycle 1 | Cycle 2 | Cycle 3 | Cycle 4 |
|---|---|---|---|---|---|
| $\mu$g Fe/g sand | 336 | 341 | 343 | 329 | 332 |

Another test was conducted to ascertain the effect of the catalyst coating and the amount thereof needed to effectively catalyze oxidation of the binder. The Figure shows the results of that test. More specifically, the Figure shows that at 500° C., and catalyst levels as low as 0.1% $Fe_2O_3$, about 82% to 86% of the binder had burned-out in the first ten minutes of treatment compared to only 70% for sand without the catalyst coating. Similarly after fifteen minutes, virtually all of the binder had burned out in contrast to only about 85% for the uncatalyzed sand. It took about 20 minutes for all of the binder to burn out of the uncatalyzed sand. Visual observations confirmed these results. In this regard, after baking at 500° C., iron oxide catalyzed cores were remarkably less intact and consisted of more freer flowing sand within 10 minutes, compared to the uncatalyzed cores which remained intact until the 20 minute observation endpoint. At 20 minutes, the uncatalyzed core pieces were about 5–10 mm in size, while the iron-oxide-catalyzed core pieces were free-flowing with only some small clumps (<1 mm in size) therein.

The Figure also shows that no more than about 0.1%, by weight, catalyst (i.e. based on iron content) is needed to promote oxidation of the binder. This observation has been confirmed by other tests conducted at catalyst loadings as high as 0.8% iron. Hence, while concentrations above about 0.1% , by weight, Fe are catalytically effective, such high loadings are unnecessary.

While the invention has been described in terms of specific embodiments thereof, it is not intended to be limited thereto but rather only to the extent set forth hereafter in the claims, which follow.

What is claimed is:

1. Method of making an aluminum casting comprising the steps of (a) forming a mold part from polymer-bonded foundry sand comprising sand grains coated with an adherent layer of an oxidation-promoting catalyst, (b) casting said aluminum against said mold part so as to shape said aluminum and (c) heating said mold part sufficiently so that said catalyst promotes the oxidation of the binder and crumbling of said mold part.

2. Method according to claim 1 wherein the binder comprises gelatin.

3. Method according to claim 2 wherein said catalyst is selected from the group consisting of ferric oxide and cupric oxide.

4. Method of making a casting comprising (a) embedding a fugitive polymeric pattern in a bed of foundry sand comprising a plurality of sand grains each coated with an adherent layer of an oxidation-promoting catalyst, (b) pouring molten metal into said bed to destroy said pattern and cause the pattern to migrate into and contaminate said sand with residue from said pattern, (c) removing said casting from said bed, and (d) reclaiming said sand for reuse by heating said sand sufficiently for said catalyst to promote the oxidation and removal of said residue.

5. Method of making a casting comprising the steps of (a) forming a core from polymer-bonded foundry sand comprising sand grains coated with an adherent layer of an oxidation-promoting catalyst, (b) casting molten metal about said core so as to shape the inside of said casting, (c) allowing said casting to solidify, and (d) then heating said casting sufficiently so that said catalyst promotes the oxidation of said polymer for easy shakeout of said core from said casting.

6. Method according to claim 5 wherein said oxidation catalyst is selected from the group consisting of ferric oxide and cupric oxide.

* * * * *